US011453227B2

(12) United States Patent
Uemura et al.

(10) Patent No.: US 11,453,227 B2
(45) Date of Patent: Sep. 27, 2022

(54) DRYING APPARATUS, PRINTING SYSTEM AND DRYING METHOD THAT INJECT HOT WIND FROM NOZZLES TO SURFACE OF RECORDING MEDIUM

(71) Applicant: SCREEN HOLDINGS CO., LTD., Kyoto (JP)

(72) Inventors: Ryota Uemura, Kyoto (JP); Keisuke Hirai, Kyoto (JP); Yoshikuni Takeichi, Kyoto (JP); Takeshi Matsuda, Kyoto (JP); Kenta Hiramatsu, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 17/192,398

(22) Filed: Mar. 4, 2021

(65) Prior Publication Data

US 2021/0291563 A1 Sep. 23, 2021

(30) Foreign Application Priority Data

Mar. 23, 2020 (JP) ..... JP2020-050486

(51) Int. Cl.
*B41J 11/00* (2006.01)
*B41J 2/155* (2006.01)

(52) U.S. Cl.
CPC ..... *B41J 11/0022* (2021.01); *B41J 2/155* (2013.01); *B41J 11/007* (2013.01)

(58) Field of Classification Search
CPC ..... B41J 11/0022; B41J 2/155; B41J 11/007; B41J 11/0015; B41J 11/0005; B41J 11/00222; B41J 11/36
See application file for complete search history.

(56) References Cited

FOREIGN PATENT DOCUMENTS

| | | | | |
|---|---|---|---|---|
| EP | 1 358 385 | A1 | | 11/2003 |
| JP | 2000-024574 | A | | 1/2000 |
| JP | 2012-149788 | A | | 8/2012 |
| JP | 2012149788 | A | * | 8/2012 |
| KR | 20190101872 | A | | 9/2019 |
| WO | 2019/131843 | A1 | | 7/2019 |
| WO | WO-2019131843 | A1 | * | 7/2019 |

OTHER PUBLICATIONS

Extended European Search Report issued in corresponding European Patent Application No. 21160010.1-1017, dated Aug. 13, 2021.

* cited by examiner

*Primary Examiner* — Bradley W Thies
(74) *Attorney, Agent, or Firm* — McDermott Will & Emery LLP

(57) ABSTRACT

In the air-blow dryers 7*a*, 7*b*, the back surface M2 of the printing medium M is supported by the rollers 74 while the hot wind is injected from the nozzles 76*u* to the front surface M1 of the printing medium M. By extending the printing medium M along the rollers 74, the evaporation of the moisture can be promoted by the hot wind while the formation of creases of the printing medium M is suppressed against the influence of the temperature distribution caused by the latent heat of the moisture on the printing medium M. After a certain amount of the moisture is evaporated, the temperature of the printing medium M becomes relatively uniform. In the air-blow dryers 7*c*, 7*d*, the printing medium M is dried by injecting the hot wind to the printing medium M from the nozzles 76*l* and 76*u* from both sides.

15 Claims, 7 Drawing Sheets

DRYING APPARATUS, PRINTING SYSTEM AND DRYING METHOD THAT INJECT HOT WIND FROM NOZZLES TO SURFACE OF RECORDING MEDIUM

CROSS REFERENCE TO RELATED APPLICATION

The disclosure of Japanese Patent Application No. 2020-050486 filed on Mar. 23, 2020 including specification, drawings and claims is incorporated herein by reference in its entirety.

BACKGROUND OF THE INVENTION

1. Field of the Invention

This invention relates to a technique drying a printing medium, on which an aqueous ink is adhered, by a hot wind.

2. Description of the Related Art

In the case of printing a printing medium by an aqueous ink, the printing medium needs to be dried to evaporate the moisture of the aqueous ink. Accordingly, it is considered to apply an air floating dryer as in JP 2000-24574A. That is, in JP 2000-24574A, floating nozzles are arranged above and below a drying body to be dried, and air is blown to the drying body from both above and below by injecting the air from each floating nozzle.

SUMMARY OF THE INVENTION

In applying such a drying technique, it is considered to inject a hot wind to a printing medium from nozzles to realize efficient drying. However, an amount of an aqueous ink is not necessarily uniform on the printing medium. Accordingly, when the printing medium is heated by the hot wind, a temperature distribution of the printing medium becomes nonuniform by the influence of the latent heat of the aqueous ink and the printing medium is creased, with the result that the printing medium may contact the nozzles.

This invention was developed in view of the above problem and aims to suppress the contact of a printing medium and nozzles due to the formation of creases of the printing medium while realizing the efficient drying of the printing medium by the injection of a hot wind from the nozzles.

A drying apparatus according to the invention, comprises: a conveyor which conveys a printing medium having a recording surface and a non-recording surface opposite to the recording surface, an aqueous ink adhering to the recording surface, a preceding-stage dryer which dries the printing medium being conveyed by the conveyor; and a next-stage dryer which dries the printing medium being conveyed by the conveyor on a side downstream of the preceding-stage dryer in a moving direction of the printing medium conveyed by the conveyor, wherein: the preceding-stage dryer includes a plurality of first nozzles arrayed in the moving direction of the printing medium conveyed by the conveyor on the recording surface side of the printing medium and a plurality of rotary bodies arrayed in the moving direction of the printing medium conveyed by the conveyor on the non-recording surface side of the printing medium, the first nozzles inject a hot wind of 60° C. or higher to the recording surface, the rotary bodies have peripheral surfaces configured to contact the non-recording surface of the printing medium and rotate, following the printing medium, the next-stage dryer includes a plurality of second nozzles arrayed in the moving direction of the printing medium conveyed by the conveyor on the recording surface side of the printing medium and a plurality of third nozzles arrayed in the moving direction of the printing medium conveyed by the conveyor on the non-recording surface side of the printing medium, the second nozzles inject the hot wind to the recording surface, and the third nozzles inject the hot wind to the non-recording surface.

A drying method according to the invention, comprises: a conveying step of conveying a printing medium having a recording surface to which an aqueous ink adhered and a non-recording surface opposite to the recording surface by a conveyor; a preceding-stage drying step of drying the printing medium being conveyed by the conveyor by a preceding-stage dryer; and a next-stage drying step of drying the printing medium being conveyed by the conveyor by a next-stage dryer on a side downstream of the preceding-stage dryer in a moving direction of the printing medium conveyed by the conveyor, wherein: the preceding-stage dryer includes a plurality of first nozzles arrayed in the moving direction of the printing medium conveyed by the conveyor on the recording surface side of the printing medium and a plurality of rotary bodies arrayed in the moving direction of the printing medium conveyed by the conveyor on the non-recording surface side of the printing medium, the first nozzles inject a hot wind of 60° C. or higher to the recording surface, the rotary bodies have peripheral surfaces configured to contact the non-recording surface of the printing medium and rotate, following the printing medium, the next-stage dryer includes a plurality of second nozzles arrayed in the moving direction of the printing medium conveyed by the conveyor on the recording surface side of the printing medium and a plurality of third nozzles arrayed in the moving direction of the printing medium conveyed by the conveyor on the non-recording surface side of the printing medium, the second nozzles inject the hot wind to the recording surface, and the third nozzles inject the hot wind to the non-recording surface.

In the invention (drying apparatus, drying method) thus configured, the printing medium is dried by the hot wind in the next-stage dryer after being dried by the hot wind in the preceding-stage dryer. Accordingly, in the preceding-stage dryer, a temperature distribution of the printing medium is nonuniform due to the latent heat of a large amount of moisture remaining on the printing medium and the printing medium is easily creased. As a countermeasure against this, in the preceding-stage dryer, the non-recording surface of the printing medium is supported by the rotary bodies while the hot wind is injected to the recording surface of the printing medium from the first nozzles. By extending the printing medium along the rotary bodies in this way, the evaporation of the moisture on the recording surface can be promoted by the hot wind while the formation of creases of the printing medium is suppressed against the influence of the temperature distribution due to the latent heat of the moisture on the printing medium. After a certain amount of the moisture is evaporated in the preceding-stage dryer in this way, the temperature of the printing medium becomes relatively uniform. Accordingly, in the next-stage dryer, the printing medium is further dried by injecting the hot wind to the printing medium from the second and third nozzles arranged on both sides of the printing medium. In this way, in the invention, the contact of the printing medium and the nozzles due to the formation of creases of the printing medium can be suppressed while the efficient drying of the printing medium is realized by the injection of the hot wind from the nozzles.

A printing system, according to the invention comprises: a printing apparatus which adheres an aqueous ink to a recording surface of a printing medium having the recording surface and a non-recording surface opposite to the recording surface; and the above drying apparatus, the printing medium having the aqueous ink adhered thereto by the printing apparatus being dried by the drying apparatus. Accordingly, the contact of the printing medium and the nozzles due to the formation of creases of the printing medium can be suppressed while the efficient drying of the printing medium is realized by the injection of the hot wind from the nozzles.

As described above, according to the invention, it is possible to suppress the contact of a printing medium and nozzles due to the formation of creases of the printing medium while realizing the efficient drying of the printing medium by the injection of a hot wind from the nozzles.

As described above, according to the invention, the formation of wrinkles in an ink discharge range can be suppressed in printing an image by discharging ink to a printing medium while conveying the printing medium in a conveying direction.

DETAILED DESCRIPTION OF THE PREFERRED EMBODIMENTS

Figure 1:
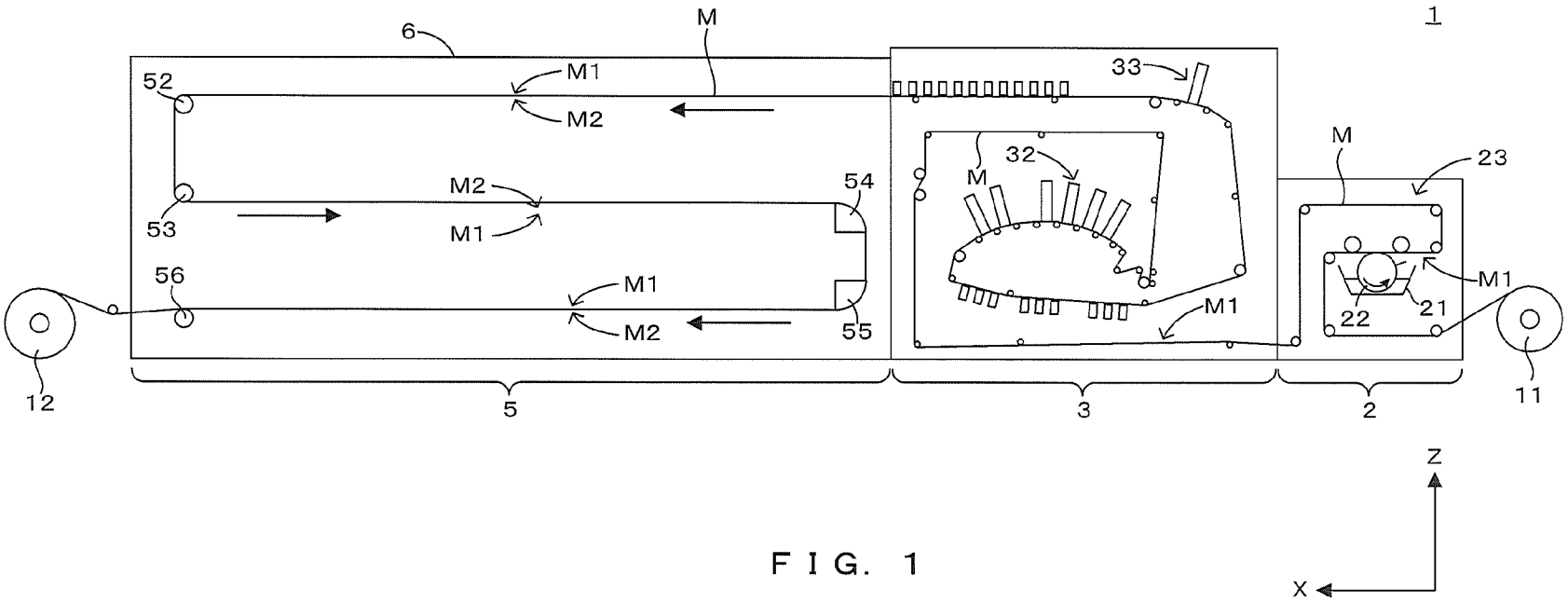
FIG. 1 is a front view schematically showing an example of a printing system according to the invention.

FIG. 1 is a front view schematically showing an example of a printing system according to the invention. In FIG. 1 and subsequent figures, a horizontal direction X and a vertical direction Z are shown as appropriate. As shown in FIG. 1, the printing system 1 has a configuration with a coating apparatus 2, a printing apparatus 3 and a drying apparatus 5 arrayed in this order in the horizontal direction X (array direction). In this printing system 1, the printing apparatus 3 prints an image by an ink-jet method on a printing medium M having a coating liquid applied thereto by the coating apparatus 2 and the drying apparatus 5 dries the printing medium M having the image printed thereon while the printing medium M in the form of an elongated belt is conveyed in a roll-to-roll manner from an unwinding roll 11 to a winding roll 12. Note that a material of the printing medium M is a film made of OPP (oriented polypropylene), PET (polyethylene terephthalate) or the like. However, the material of the printing medium M is not limited to the film and may be paper or the like. Such a printing medium M is flexible. Further, out of both surfaces of the printing medium M, the surface on which images are to be printed is referred to as a front surface M1 and the surface opposite to the front surface M1 is referred to as a back surface M2 as appropriate.

The coating apparatus 2 includes a pan 21 storing a liquid primer (coating liquid), a gravure roller 22 partially immersed in the primer stored in the pan 21 and a conveying unit 23 conveying the printing medium M. In the coating apparatus 2, a coating region is provided where the gravure roller 22 contacts the printing medium M conveyed by the conveying unit 23 from below, and the conveying unit 23 conveys the printing medium M along the coating region with the front surface M1 of the printing medium M facing down. On the other hand, the gravure roller 22 supplies the primer to the coating region by rotating while holding the primer on the peripheral surface thereof. In this way, the primer supplied by the gravure roller 22 is applied to the front surface M1 of the printing medium M in the coating region. Further, in the coating region, a moving direction of the printing medium M and a rotating direction of the peripheral surface of the gravure roller 22 are opposite. That is, the primer is applied to the printing medium M by a reverse kiss method. Then, the conveying unit 23 carries out the printing medium M from the coating apparatus 2 to the printing apparatus 3 with the front surface M1 of the printing medium M having the primer applied thereto facing up.

Figure 2:
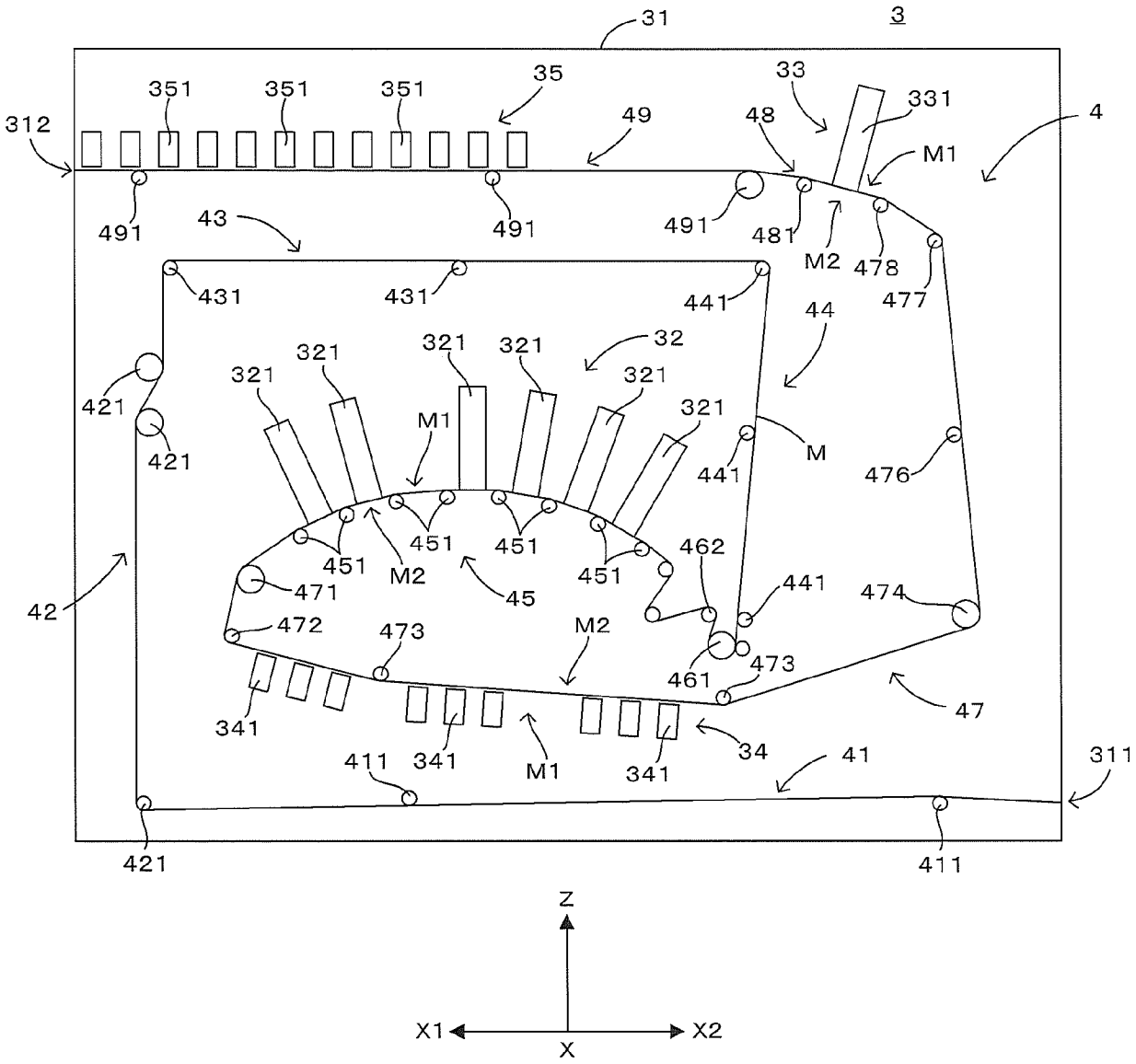
FIG. 2 is a front view schematically showing the printing apparatus provided in the printing system of FIG. 1.

FIG. 2 is a front view schematically showing the printing apparatus provided in the printing system of FIG. 1. In FIG. 2 and subsequent figures, one side X1 and the other side X2 of the horizontal direction X are shown as appropriate. Here, the one side X1 is a side from the coating apparatus 2 to the printing apparatus 3 and from the printing apparatus 3 to the drying apparatus 5, and the other side X2 is a side opposite to the one side X1. The printing apparatus 3 includes a housing 31, a color printing unit 32 arranged in the housing 31, a white printing unit 33 arranged above the color printing unit 32 in the housing 31, and a conveying unit 4 conveying the printing medium M by a plurality of rollers arranged in the housing 31.

The color printing unit 32 includes a plurality of (six) discharge heads 321 arrayed in the moving direction (direction from the other side X2 toward the one side X1) of the printing medium M above the printing medium M conveyed by the conveying unit 4. The plurality of discharge heads 321 include nozzles facing the front surface M1 of the printing medium M passing therebelow from above, and discharge color inks of mutually different colors from the nozzles by the ink-jet method. Here, the color inks mean inks other than a white ink and include inks of cyan, magenta, yellow, black and the like. In this way, the plurality of discharge heads 321 of the color printing unit 32 print a color image on the front surface M1 of the printing medium M by discharging the color inks to the front surface M1 of the printing medium M passing therebelow from above.

Further, the white printing unit 33 includes a single discharge head 331 arranged above the printing medium M conveyed by the conveying unit 4. The discharge head 331 includes nozzles facing the front surface M1 of the printing medium M passing therebelow from above, and discharges the white ink from the nozzles by the ink-jet method. In this way, the discharge head 321 of the white printing unit 33 prints a white image on the front surface M1 of the printing medium M by discharging the white ink to the front surface M1 of the printing medium M passing therebelow from above.

A carry-in port 311 is open in a side wall on the other side X2 of the housing 31. The printing medium M carried out from the coating apparatus 2 is carried into the housing 31 through the carry-in port 311. In contrast, the conveying unit 4 includes a carry-in part 41 (fourth conveying part). The carry-in part 41 includes a plurality of rollers 411 arrayed in the horizontal direction X below the color printing unit 32 and conveys the printing medium M carried in from the carry-in port 311 from the other side X2 toward the one side X1 while supporting the printing medium M by the plurality of rollers 411.

Further, the conveying unit 4 includes an ascending conveying part 42 (fifth conveying part) provided on the one side X1 of the carry-in part 41. The ascending conveying part 42 includes a plurality of rollers 421 arrayed in the vertical direction Z outside (one side X1 of) the color printing unit 32. This ascending conveying part 42 conveys the printing medium M upward while supporting the printing medium M by the plurality of rollers 421 after changing the moving direction of the printing medium M from a direction toward the one side X1 to an upward direction by bending the printing medium M, which is conveyed from the carry-in part 41, upward by the lowermost roller 421, out of the plurality of rollers 421.

Further, the conveying unit 4 includes an upper conveying part 43 (sixth conveying part) provided above the color printing unit 32. The upper conveying part 43 includes a plurality of rollers 431 arrayed in the horizontal direction X above the color printing unit 32. This upper conveying part 43 conveys the printing medium M toward the other side X2 while supporting the printing medium M by the plurality of rollers 431 after changing the moving direction of the printing medium M from the upward direction to a direction toward the other side X2 by bending the printing medium M, which is conveyed from the ascending conveying part 42, toward the other side X2 by the roller 431 located at the end of the one side X1, out of the plurality of rollers 431.

Further, the conveying unit 4 includes a descending conveying part 44 (seventh conveying part) provided on the other side X2 of the upper conveying part 43. The descending conveying part 44 includes a plurality of rollers 441 arrayed in the vertical direction Z outside (other side X2 of) the color printing unit 32. This descending conveying part 44 conveys the printing medium M downward while supporting the printing medium M by the plurality of rollers 441 after changing the moving direction of the printing medium M from the direction toward the other side X2 to a downward direction by bending the printing medium M, which is conveyed from the upper conveying part 43, downward by the uppermost roller 441, out of the plurality of rollers 441. Out of the plurality of rollers 441 of this descending conveying part 44, the uppermost roller 441 is located to be higher than the respective discharge heads 321 of the color printing unit 32, and the lowermost roller 441 is located to be lower than the respective discharge heads 321 of the color printing unit 32. That is, the descending conveying part 44 conveys the printing medium M from a side above the color printing unit 32 to a side below the color printing unit 32.

Further, the conveying unit 4 includes a color conveying part 45 (first conveying part) provided below the upper conveying part 43 and on the one side X1 of the descending conveying part 44. This color conveying part 45 includes a plurality of rollers 451 arrayed in the horizontal direction X and configured to contact the back surface M2 of the printing medium M, and the printing medium M conveyed from the descending conveying part 44 is supported below the color printing unit 32 by the plurality of rollers 451. In this way, the plurality of rollers 451 of the color conveying part 45 convey the printing medium M from the other side X2 toward the one side X1 while supporting the printing medium M conveyed from the descending conveying part 44 from below by contacting the back surface M2 of the printing medium M from below. The color printing unit 32 discharges the color inks from above to the front surface M1 of the printing medium M conveyed along the front surface M1 by the color conveying part 45.

At this time, the front surface M1 of the printing medium M conveyed by the color conveying part 45 is facing up, and the back surface M2 of the printing medium M is facing down. Specifically, the printing medium M carried out from the coating apparatus 2 is carried in through the carry-in port 311 with the front surface M1 thereof facing up, and conveyed from the other side X2 toward the one side X1 by the carry-in part 41. The printing medium M having passed through the carry-in part 41 is conveyed from the one side X1 toward the other side X2 by the upper conveying part 43 while being vertically inverted by the ascending conveying part 42 and the upper conveying part 43. Thus, the front surface M1 of the printing medium M conveyed by the upper conveying part 43 is facing down. The printing medium M having passed through the upper conveying part 43 is conveyed from the other side X2 toward the one side X1 by the color conveying part 45 while being vertically inverted by the descending conveying part 44 and the color conveying part 45. Thus, the front surface M1 of the printing medium M conveyed by the color conveying part 45 is facing up.

Further, the conveying unit 4 includes rollers 461, 462 configured to contact the front surface M1 of the printing medium M on a side upstream of the color conveying part 45 in the moving direction of the printing medium M. The roller 461 is a drive roller driving the printing medium M, and the roller 462 is a driven roller including a tension sensor detecting a tension applied to the printing medium M. Such drive roller 461 and driven roller 462 constitute a tension adjuster which adjusts a tension of the printing medium M together with a driven roller 472 including a later-described tension sensor detecting a tension applied to the printing medium M, a drive roller 471 and a drive roller 491. Specifically, the rollers 461, 471 and 491 respectively rotate at speeds corresponding to the tensions detected by the tension sensors of the rollers 462, 472, whereby the entire tension of the printing medium M conveyed by the conveying unit 4 is adjusted to a predetermined target tension. In this way, the color inks and the white ink can be discharged to the printing medium while a proper tension is applied to the printing medium.

Further, the conveying unit 4 includes an inverting conveying part 47 vertically inverting the printing medium, which is conveyed from the color conveying part 45 toward the one side X1, twice. This inverting conveying part 47 includes a plurality of rollers 471, 472 arrayed in the vertical direction Z on the one side X1 of the color conveying part 45 and configured to contact the back surface M2 of the printing medium M. Out of the plurality of rollers 471, 472, the upper roller 471 changes the moving direction of the printing medium M from the direction toward the one side X1 to the downward direction by bending the printing medium M, which is conveyed from the color conveying part 45, downward, and the lower roller 472 changes the moving direction of the printing medium M from the downward direction to the direction toward the other side X2 by bending the printing medium M, which is conveyed from the roller 471, toward the other side X2. In this way, the printing medium M is vertically inverted by the rollers 471, 472 in contact with the back surface M2 of the printing medium M, whereby the back surface M2 of the printing medium M is facing up and the front surface M1 of the printing medium M is facing down.

Further, the inverting conveying part 47 includes a plurality of rollers 473 arrayed in the horizontal direction X below the color conveying part 45 and on the other side X2 of the roller 472 and configured to contact the back surface M2 of the printing medium M. These rollers 473 convey the printing medium M conveyed from the roller 472 from the one side X1 toward the other side X2. In this way, the printing medium M whose back surface M2 is facing up is conveyed from the one side X1 toward the other side X2 by the plurality of rollers 473 in contact with the back surface M2 of the printing medium M.

Furthermore, the inverting conveying part 47 includes a plurality of rollers 474, 476 and 477 arrayed in the vertical direction Z on the other side X2 of the plurality of rollers 473 and the descending conveying part 44 and configured to contact the back surface M2 of the printing medium M. Out of the plurality of rollers 474 to 477, the lowermost roller 474 changes the moving direction of the printing medium M from the direction toward the other side X2 to the upward direction by bending the printing medium M, which is conveyed from the plurality of rollers 473, upward, and the uppermost roller 477 changes the moving direction of the printing medium M from the upward direction to the direction toward the one side X1 by bending the printing medium M, which is conveyed from the roller 474 via the roller 476, toward the one side X1. In this way, the printing medium M is vertically inverted by the rollers 474 to 477 in contact with the back surface M2 of the printing medium M, whereby the front surface M1 of the printing medium M is facing up and the back surface M2 of the printing medium M is facing down.

Further, the inverting conveying part 47 includes a roller 478 arranged above the upper conveying part 43 and on the one side X1 of the roller 477 and configured to contact the back surface M2 of the printing medium M. The roller 478 conveys the printing medium M conveyed from the roller 477 from the other side X2 toward the one side X1. In this way, the printing medium M whose front surface M1 is facing up is conveyed from the other side X2 toward the one side X1 by the roller 478 in contact with the back surface M2 of the printing medium M.

As just described, the inverting conveying part 47 vertically inverts the front surface M1 and the back surface M2 of the printing medium M by conveying the printing medium M conveyed from the color conveying part 45 downward by the rollers 471, 472 and further conveying the printing medium M with changing the moving direction of the printing medium M to the direction toward the other side X2 by the roller 472. Subsequently, the inverting conveying part 47 conveys the printing medium M from the one side X1 toward the other side X2 by the plurality of rollers 473, and then conveys the printing medium M upward by the rollers 474 to 477. Further, the inverting conveying part 47 vertically inverts the front surface M1 and the back surface M2 of the printing medium M again by changing the moving direction of the printing medium M to the direction toward the one side X1 by the roller 477, and conveys the printing medium M from the other side X2 toward the one side X1 by the roller 478.

In this way, the inverting conveying part 47 vertically inverts the front surface M1 and the back surface M2 of the printing medium M twice by the only rollers 471 to 478 rotating while being in contact with the back surface M2 of the printing medium M and having the back surface M2 wound thereon. Specifically, the inverting conveying part 47 can vertically invert the front surface M1 and the back surface M2 of the printing medium M twice without providing supporting members such as rollers and air turn bars on the side of the front surface M1 of the printing medium M at all.

Further, the conveying unit 4 includes a white conveying part 48 (second conveying part) provided above the upper conveying part 43 and on the one side X1 of the roller 478 of the inverting conveying part 47. This white conveying part 48 includes a roller 481, and the printing medium M conveyed from the roller 478 of the inverting conveying part 47 is supported below the white printing unit 33 by the roller 481. As just described, the roller 481 of the white conveying part 48 conveys the printing medium M from the other side X2 toward the one side X1 while supporting the printing medium M from below by being in contact with the back surface M2 of the printing medium M conveyed from the roller 478 of the inverting conveying part 47 from below. The white printing unit 33 discharges the white ink from above to the front surface M1 of the printing medium M conveyed along the front surface M1 by the white conveying part 48.

Further, the conveying unit 4 includes a carry-out part 49 (third conveying part) provided above the upper conveying part 43 and on the one side X1 of the white conveying part 48. The carry-out part 49 includes a plurality of rollers 491 arrayed in the horizontal direction X and configured to contact the back surface M2 of the printing medium M. In contrast, a carry-out port 312 is open in a side wall on the one side X1 of the housing 31, and the plurality of rollers 491 of the carry-out part 49 carry out the printing medium M from the carry-out port 312 by conveying the printing medium M from the other side X2 toward the one side X1 while being in contact with the back surface M2 of the printing medium M from below.

As just described, the conveying unit 4 includes supporting members to support the printing medium M, which is vertically inverted twice and reaches the carry-out port 312 after entering the color conveying part 45, not on the side of the front surface M1 of the printing medium M, but only on the side of the back surface M2 of the printing medium M.

Further, the printing apparatus 3 includes a pre-dryer 34 arranged in the housing 31. The pre-dryer 34 is arranged between the carry-in part 41 and the inverting conveying part 47 in the vertical direction Z. This pre-dryer 34 includes a plurality of nozzles 341 arrayed in the moving direction of the printing medium M conveyed from the one side X1 toward the other side X2 by the plurality of rollers 473 of the inverting conveying part 47. Each nozzle 341 faces the front surface M1 of the printing medium M conveyed by the plurality of rollers 473 from below and injects room-temperature air to the front surface M1 of this printing medium M from below. That is, the front surface M1 of the printing medium M, to which the color inks were discharged from the color printing unit 32, is dried by the pre-dryer 34. Note that this pre-dryer 34 is not necessarily limited to the one between the carry-in part 41 and the inverting conveying part 47, and the arrangement position of the pre-dryer 34 is not limited as long as the pre-dryer 34 can be positioned to inject air to the front surface M1 of the printing medium M conveyed by the inverting conveying part 47. Specifically, this pre-dryer 34 can be so arranged that air can be injected to the front surface M1 of the printing medium M before the white ink is discharged to the front surface M1 of the printing medium M by the white printing unit 33 after the color inks are discharged to the front surface of the printing medium M by the color printing unit 32. However, if this pre-dryer 34 is arranged between the carry-in part 41 and the inverting conveying part 47, there is a merit that a space below the inverting conveying part 47 can be utilized as an arrangement space for the pre-dryer and the printing apparatus can be reduced in size in the horizontal direction.

Furthermore, the printing apparatus 3 includes an upper dryer 35 arranged in the housing 31. The upper dryer 35 is arranged above the carry-out part 49. This upper dryer 35 includes a plurality of nozzles 351 arrayed in the moving direction of the printing medium M conveyed from the other side X2 toward the one side X1 by the carry-out part 49. Each nozzle 351 faces the front surface M1 of the printing medium M conveyed by the carry-out part 49 from above and injects room-temperature air to the front surface M1 of this printing medium M from above. That is, the front surface M1 of the printing medium M, to which the white ink was discharged from the white printing unit 33, is dried by the upper dryer 35.

Figure 3:
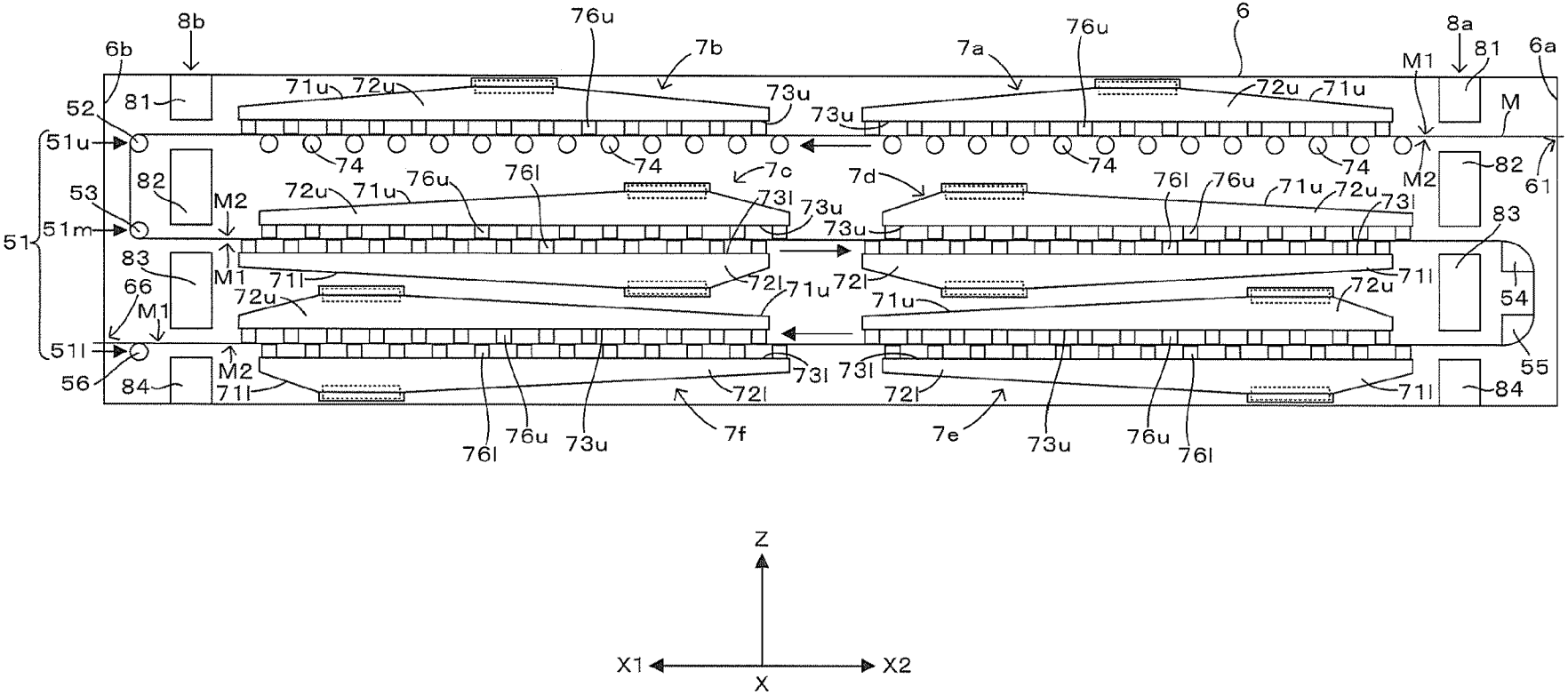
FIG. 3 is a front view schematically showing the drying apparatus equipped in the printing system of FIG. 1.

FIG. 3 is a front view schematically showing the drying apparatus equipped in the printing system of FIG. 1. The drying apparatus 5 dries the printing medium M while appropriately conveying the printing medium M in the horizontal direction X in a zigzag manner. This drying apparatus 5 includes a housing 6 (drying furnace) arranged on the one side X1 of the housing 31 of the printing apparatus 3. This housing 6 has a rectangular parallelepiped shape extending in the horizontal direction X, and both side walls 6*a*, 6*b* of the housing 6 in the horizontal direction X are parallel to the vertical direction Z, perpendicular to the horizontal direction X and facing each other while being spaced apart in the horizontal direction X.

A carry-in port 61 penetrates in the horizontal direction X through the side wall 6*a* on the side X2 of the horizontal direction X, out of the side walls 6*a*, 6*b*, and a carry-out port 66 penetrates in the horizontal direction X through the side wall 6*b* on the side X1 (side opposite to the printing apparatus 3) of the horizontal direction X. The printing medium M carried out from the carry-out port 312 of the printing apparatus 3 is carried into the housing 6 through the carry-in port 61 and carried out to the outside of the housing 6 through the carry-out port 66.

That is, the drying apparatus 5 includes a conveying unit 51 conveying the printing medium M in the housing 6, and the conveying unit 51 conveys the printing medium M from the carry-in port 61 to the carry-out port 66. This conveying unit 51 includes an upper-stage conveying part 51*u* conveying the printing medium M from the other side X2 toward the one side X1, a middle-stage conveying part 51*m* conveying the printing medium M from the one side X1 toward the other side X2, and a lower-stage conveying part 51*l* conveying the printing medium M from the other side X2 toward the one side X1. The middle-stage conveying part 51*m* is arranged below the upper-stage conveying part 51*u*, and the lower-stage conveying part 51*l* is arranged below the middle-stage conveying part 51*m*. Accordingly, the printing medium M conveyed by the upper-stage conveying part 51*u*, the printing medium M conveyed by the middle-stage conveying part 51*m* and the printing medium conveyed by the lower-stage conveying part 51*l* are arranged in the vertical direction Z, in other words, overlap each other when viewed from the vertical direction Z. Specifically, the upper-stage conveying part 51*u* conveys the printing medium M at the same height as the carry-in port 61, and the printing medium M is conveyed in the horizontal direction X by the upper-stage conveying part 51*u* with the front surface M1 facing up and the back surface M2 facing down. The middle-stage conveying part 51*m* conveys the printing medium M below the upper-stage conveying part 51*u*, and the printing medium M is conveyed in the horizontal direction X by the middle-stage conveying part 51*m* with the front surface M1 facing down and the back surface M2 facing up. The lower-stage conveying part 51*l* conveys the printing medium M below the middle-stage conveying part 51*m*, and the printing medium M is conveyed in the horizontal direction X by the lower-stage conveying part 51*l* with the front surface M1 facing up and the back surface M2 facing down.

The upper-stage conveying part 51*u* includes a roller 52 at an end of the one side X1, and the middle-stage conveying part 51*m* includes a roller 53 at an end on the one side X1. The rollers 52, 53 are vertically arranged, and fold the printing medium M from the one side X1 toward the other side X2. That is, out of the rollers 52, 53, the roller 52 on an upper side folds the printing medium M downward by contacting the back surface M2 of the printing medium M conveyed from the carry-in port 61 toward the one side X1, and the roller 53 on a lower side folds the printing medium M toward the other side X2 by contacting the back surface M2 of the printing medium M conveyed downward from the roller 52. By folding the printing medium M from the one side X1 toward the other side X2 in this way, the front surface M1 and the back surface M2 of the printing medium M are vertically inverted.

Further, the middle-stage conveying part 51*m* includes an air turn bar 54 at an end on the other side X2, and the lower-stage conveying part 51*l* includes an air turn bar 55 at an end on the other side X2. The air turn bars 54, 55 are vertically arranged, and fold the printing medium M from the other side M2 toward the one side X1. That is, out of the air turn bars 54, 55, the air turn bar 54 on an upper side injects air to the front surface M1 of the printing medium M conveyed from the roller 53 toward the other side X2. In this way, the air turn bar 54 folds the printing medium M downward while being spaced apart from the front surface M1 of the printing medium M. Further, the air turn bar 55 on a lower side injects air to the front surface M1 of the printing medium M conveyed downward from the air turn bar 54. In this way, the air turn bar 55 folds the printing medium M toward the one side X1 while being spaced apart from the front surface M1 of the printing medium M. By folding the printing medium M from the other side X2 toward the one side X1 in this way, the front surface M1 and the back surface M2 of the printing medium M are vertically inverted.

Further, the lower-stage conveying part 51*l* includes a roller 56 at an end on the one side X1. This roller 56 is arranged for the carry-out port 66, and conveys the printing medium M toward the carry-out port 66 by rotating while contacting the back surface M2 of the printing medium M conveyed from the air turn bar 55 toward the one side X1.

Such a drying apparatus 5 includes six air-blow dryers 7*a* to 7*f*. Out of these, two air-blow dryers 7*a*, 7*b* are provided for the printing medium M conveyed by the upper-stage conveying part 51*u* and arranged between the carry-in port 61 and the roller 52. The air-blow dryers 7*a*, 7*b* dry the printing medium M conveyed by the upper-stage conveying part 51*u*. Two air-blow dryers 7*c*, 7*d* are provided for the printing medium M conveyed by the middle-stage conveying part 51*m* and arranged between the roller 53 and the air turn bar 54. The air-blow dryers 7*c*, 7*d* dry the printing medium M conveyed by the middle-stage conveying part 51*m*. Two air-blow dryers 7*e*, 7*f* are provided for the printing medium M conveyed by the lower-stage conveying part 51*l* and arranged between the air turn bar 55 and the carry-out port 66. The air-blow dryers 7*e*, 7*f* dry the printing medium M conveyed by the lower-stage conveying part 51*l*.

Figure 4:
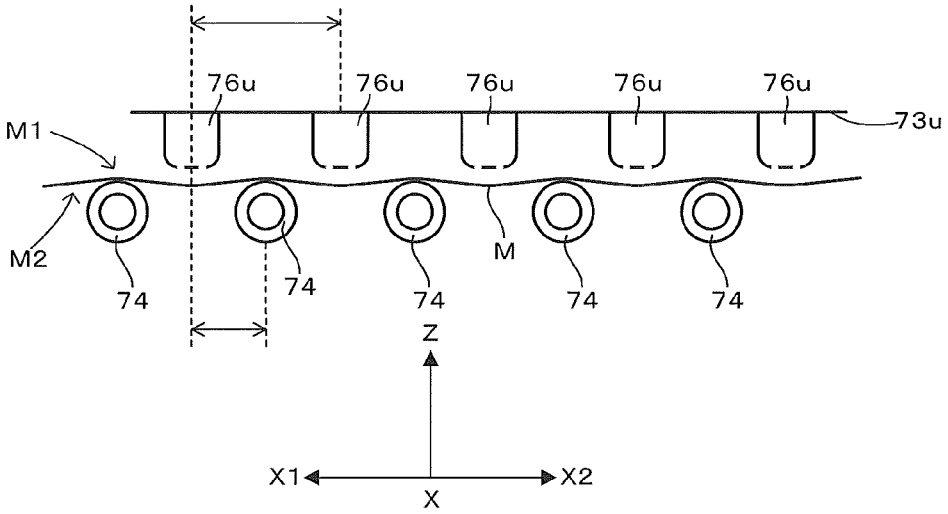
FIG. 4 is a schematic diagram partially and enlargedly showing the air-blow dryer provided for the upper-stage conveying part.
Figure 5:
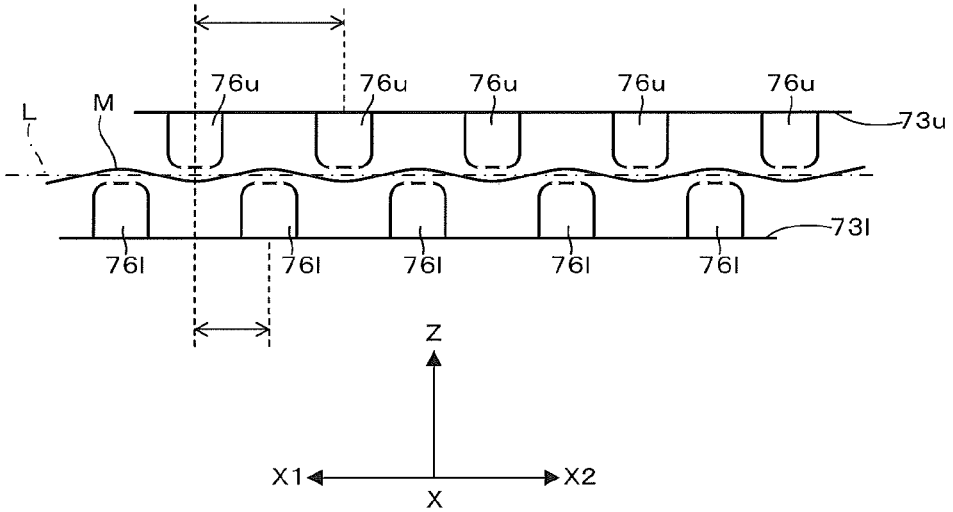
FIG. 5 is a schematic diagram partially and enlargedly showing the air-blow dryer provided for the middle—conveying part and the lower-stage conveying part.

FIG. 4 is a schematic diagram partially and enlargedly showing the air-blow dryer provided for the upper-stage conveying part, and FIG. 5 is a schematic diagram partially and enlargedly showing the air-blow dryer provided for the middle—conveying part and the lower-stage conveying part. Next, the air-blow dryers 7*a* to 7*f* are described also with reference to FIGS. 4 and 5.

The air-blow dryer 7*a* includes an air blower unit 71*u* arranged above the printing medium M conveyed by the upper-stage conveying part 51*u*. The air blower unit 71*u* includes an air blower chamber 72*u* extending in the horizontal direction X above the printing medium M. Opposite end surfaces in the horizontal direction X of the air blower chamber 72*u* are planes perpendicular to the horizontal direction X and parallel to the vertical direction Z. A hot wind generated by heating air by a heater provided outside the printing system 1 is supplied to the air blower chamber 72*u*. The lower surface of the air blower chamber 72*u* is a nozzle arrangement plane 73*u* facing the front surface M1 (upper surface) of the printing medium M facing up from above. This nozzle arrangement plane 73*u* is a plane parallel to the horizontal direction X and perpendicular to the vertical direction Z. Further, the air blower unit 71*u* includes a plurality of nozzles 76*u* arranged at a predetermined interval in the horizontal direction X on this nozzle arrangement plane 73*u*. In this way, the plurality of nozzles 76*u* are arranged between the nozzle arrangement plane 73*u* and the front surface M1 of the printing medium M and face the front surface M1 of the printing medium M. The respective nozzles 76*u* communicate with the air blower chamber 72*u*, and the hot wind supplied to the air blower chamber 72*u* is injected to the front surface M1 of the printing medium M from the nozzles 76*u* to dry the printing medium M. As just described, out of the plurality of air-blow dryers 7*a* to 7*f*, the air-blow dryer 7*a* first dries the printing medium M carried into the housing 6.

Further, the air-blow dryer 7*a* includes a plurality of (as many as the nozzles 76*u*) rollers 74 arranged below the printing medium M conveyed by the upper-stage conveying part 51*u*. The plurality of rollers 74 are arrayed at a predetermined interval in the moving direction (horizontal direction X) of the printing medium M conveyed by the upper-stage conveying part 51*u*, and the peripheral surface of each roller 74 contacts the back surface M2 (lower surface) of the printing medium M conveyed by the upper-stage conveying part 51*u* from below. Each roller 74 supports the printing medium M from below while rotating about an axis of rotation parallel to a direction (width direction of the printing medium M) perpendicular to the horizontal direction X and the vertical direction Z, following the printing medium M. Further, a fine groove is spirally provided on the roller 74, so that air easily escapes from between the printing medium M and the peripheral surface of the roller 74.

Incidentally, the nozzle 76*u* faces a range between two rollers 74 adjacent in the horizontal direction X from above, and the roller 74 faces a range between two nozzles 76*u* adjacent in the horizontal direction X from below. That is, the nozzles 76*u* and the rollers 74 are alternately arranged at an interval, which is half the predetermined interval, in the horizontal direction X, and alternately arranged one by one in the horizontal direction X in a plan view viewed from the vertical direction Z. In other words, the nozzles 76*u* and the rollers 74 are arrayed in a staggered manner.

In such a configuration, as shown in FIG. 4, the printing medium M is shifted further downward than the upper ends of the rollers 74 by being pressed downward by the hot wind from the nozzles 76*u* in parts facing the nozzles 76*u*, and is supported by the rollers 74 in parts facing the rollers 74. Accordingly, the printing medium M is conveyed in the horizontal direction X from the other side X2 toward the one side X1 while becoming wavy between the upper ends of the rollers 74 and a side below these upper ends.

Further, as shown in FIG. 4, the upper ends of the rollers 74 are located below the lower ends of the nozzles 76*u*. Accordingly, there is a clearance in the vertical direction Z between the nozzles 76*u* and the rollers 74 when viewed from an array direction (horizontal direction X) of the nozzles 76*u* or the rollers 74, in other words, from the moving direction of the printing medium M conveyed by the upper-stage conveying part 51*u*. Thus, if the injection of the hot wind from the nozzles 76*u* is stopped due to the occurrence of a certain trouble, the printing medium M is supported from below by the rollers 74 with the front surface M1 of the printing medium M separated from the nozzles 76*u* and the back surface M2 of the printing medium M held in contact with the rollers 74.

The air-blow dryer 7*b* is arranged downstream of the air-blow dryer 7*a* in the moving direction of the printing medium M conveyed by the upper-stage conveying part 51*u*. Similarly to the air-blow dryer 7*a*, this air-blow dryer 7*b* includes an air blower unit 71*u* arranged above the printing medium M conveyed by the upper-stage conveying part 51*u* and a plurality of rollers 74 arranged below the printing medium M. In such an air-blow dryer 7*b*, a plurality of (as many as rollers 74) of nozzles 76*u* of the air blower unit 71*u* inject a hot wind to the front surface M1 of the printing medium M from above to dry the printing medium M while the plurality of rollers 74 support the back surface M2 of the printing medium M from below.

The air-blow dryer 7*c* includes air blower units 71*u*, 71*l* respectively arranged above and below the printing medium M conveyed by the middle-stage conveying part 51*m*. The upper air blower unit 71*u* includes an air blower chamber 72*u* extending in the horizontal direction X above the printing medium M. Opposite end surfaces in the horizontal direction X of the air blower chamber 72*u* are planes perpendicular to the horizontal direction X and parallel to the vertical direction Z. The above hot wind is supplied to the air blower chamber 72*u*. The lower surface of the air blower chamber 72*u* is a nozzle arrangement plane 73*u* facing the back surface M2 (upper surface) of the printing medium M facing up from above. This nozzle arrangement plane 73*u* is a plane parallel to the horizontal direction X and perpendicular to the vertical direction Z. Further, the air blower unit 71*u* includes a plurality of nozzles 76*u* arranged at a predetermined interval in the horizontal direction X on this nozzle arrangement plane 73*u*. In this way, the plurality of nozzles 76*u* are arranged between the nozzle arrangement plane 73*u* and the back surface M2 of the printing medium M and face the back surface M2 of the printing medium M. The respective nozzles 76*u* communicate with the air blower chamber 72*u*, and the hot wind supplied to the air blower chamber 72*u* is injected to the back surface M2 of the printing medium M from the nozzles 76*u*.

The lower air blower unit 71*l* includes an air blower chamber 72*l* extending in the horizontal direction X below the printing medium M. Opposite end surfaces in the horizontal direction X of the air blower chamber 72*l* are planes perpendicular to the horizontal direction X and parallel to the vertical direction Z. The above hot wind is supplied to the air blower chamber 72*l*. The upper surface of the air blower chamber 72*l* is a nozzle arrangement plane 73*l* facing the front surface M1 (lower surface) of the printing medium M facing down from below. This nozzle arrangement plane 73*l* is a plane parallel to the horizontal direction X and perpendicular to the vertical direction Z. Further, the air blower unit 71*l* includes a plurality of nozzles 76*l* arranged at a predetermined interval in the horizontal direction X on this nozzle arrangement plane 73*l*. In this way, the plurality of nozzles 76*l* are arranged between the nozzle arrangement plane 73*l* and the front surface M1 of the printing medium M and face the front surface M1 of the printing medium M. The respective nozzles 76*l* communicate with the air blower chamber 72*l*, and the hot wind supplied to the air blower chamber 72*l* is injected to the front surface M1 of the printing medium M from the nozzles 76*l*.

As just described, the air blower units 71*u*, 71*l* sandwich the printing medium M. In other words, the printing medium M conveyed by the middle-stage conveying part 51*m* passes between the air blower units 71*u* and 71*l*. In this way, the air-blow dryer 7*c* dries the printing medium M by injecting the hot wind to the printing medium M conveyed by the middle-stage conveying part 51*m* from the both upper and lower air blower units 71*u*, 71*l*.

Incidentally, the upper nozzle 76*u* faces a range between two nozzles 76*l* adjacent in the horizontal direction X from above, and the lower nozzle 76*l* faces a range between two upper nozzles 76*u* adjacent in the horizontal direction X from below. That is, the upper and lower nozzles 76*u*, 76*l* are alternately arranged at an interval, which is half the predetermined interval, in the horizontal direction X, and alternately arranged one by one in the horizontal direction X in a plan view viewed from the vertical direction Z. In other words, the nozzles 76*u*, 76*l* are arrayed in a staggered manner. Such a staggered array of the nozzles 76*u*, 76*l* is realized by displacing the positions of the air blower chambers 72*u*, 72*l* from each other in the horizontal direction X.

In such a configuration, as shown in FIG. 5, the printing medium M is shifted further downward than a conveyance center line L by being pressed downward by the hot wind from the nozzles 76*u* in parts facing the upper nozzles 76*u*, and is shifted further upward than the conveyance center line L by being pressed upward by the hot wind from the nozzles 76*l* in parts facing the lower nozzles 76*l*. Here, the conveyance center line L is a horizontal virtual straight line equidistant from each nozzle 76*u* and each nozzle 76*l* in the vertical direction Z. Thus, the printing medium M is conveyed in the horizontal direction X from the one side X1 toward the other side X2 while becoming wavy between upper and lower sides of the conveyance center line L.

The air-blow dryer 7*d* is arranged downstream of the air-blow dryer 7*c* in the moving direction of the printing medium M conveyed by the middle-stage conveying part 51*m*. This air-blow dryer 7*d* includes air blower units 71*u*, 71*l* sandwiching the printing medium M conveyed by the middle-stage conveying part 51*m* in the vertical direction Z, similarly to the air-blow dryer 7*c*. In such an air-blow dryer 7*d*, the air blower unit 71*u* injects the hot wind to the back surface M2 of the printing medium M from above, and the air blower unit 71*l* injects the hot wind to the front surface M1 of the printing medium M from below, whereby the printing medium M is dried.

Similarly to the air-blow dryer 7*c*, the air-blow dryer 7*e* includes air blower units 71*u*, 71*l* sandwiching the printing medium M in the vertical direction Z. However, since the air-blow dryer 7*e* is arranged for the printing medium M conveyed by the lower-stage conveying part 51*l*, the air blower units 71*u*, 71*l* of the air-blow dryer 7*e* sandwich the printing medium M conveyed by the lower-stage conveying part 51*l* in the vertical direction Z. In such an air-blow dryer 7*e*, the air blower unit 71*u* injects the hot wind to the front surface M1 of the printing medium M from above, and the air blower unit 71*l* injects the hot wind to the back surface M2 of the printing medium M from below, whereby the printing medium M is dried.

The air-blow dryer 7*f* is arranged downstream of the air-blow dryer 7*e* in the moving direction of the printing medium M conveyed by the lower-stage conveying part 51*l*. This air-blow dryer 7*f* includes air blower units 71*u*, 71*l* sandwiching the printing medium M conveyed by the lower-stage conveying part 51*l* in the vertical direction Z, similarly to the air-blow dryer 7*e*. In such an air-blow dryer 7*f*, the air blower unit 71*u* injects the hot wind to the front surface M1 of the printing medium M from above, and the air blower unit 71*l* injects the hot wind to the back surface M2 of the printing medium M from below, whereby the printing medium M is dried.

Further, the drying apparatus 5 includes exhaust units 8*a*, 8*b* in the housing 6, exhaust units 8*a*, 8*b* exhausts the air in the housing 6 to outside of the housing 6. The exhaust unit 8*a* is arranged at an end part on the side X2 in the housing 6 and located between the air-blow dryers 7*a*, 7*d* and 7*e* and the side wall 6*a*. The exhaust unit 8*b* is arranged at an end part on the X1 side in the housing 6 and located between the air-blow dryers 7*b*, 7*c* and 7*f* and the side wall 6*b*. These exhaust units 8*a*, 8*b* have a common configuration. The exhaust unit 8*a*, 8*b* includes four exhaust chambers 81 to 84 arrayed in the vertical direction Z. The exhaust chamber 81 is arranged above the printing medium M conveyed by the upper-stage conveying part 51*u*, the exhaust chamber 82 is arranged between the printing medium M conveyed by the upper-stage conveying part 51*u* and the printing medium M conveyed by the middle-stage conveying part 51*m*, the exhaust chamber 83 is arranged between the printing medium M conveyed by the middle-stage conveying part 51*m* and the printing medium M conveyed by the lower-stage conveying part 51*l*, and the exhaust chamber 84 is arranged below the printing medium M conveyed by the lower-stage conveying part 51*l*. Each of the exhaust chambers 81 to 84 exhausts the air sucked from the inside of the housing 6 to the outside of the carry-in port 61.

Figure 6:
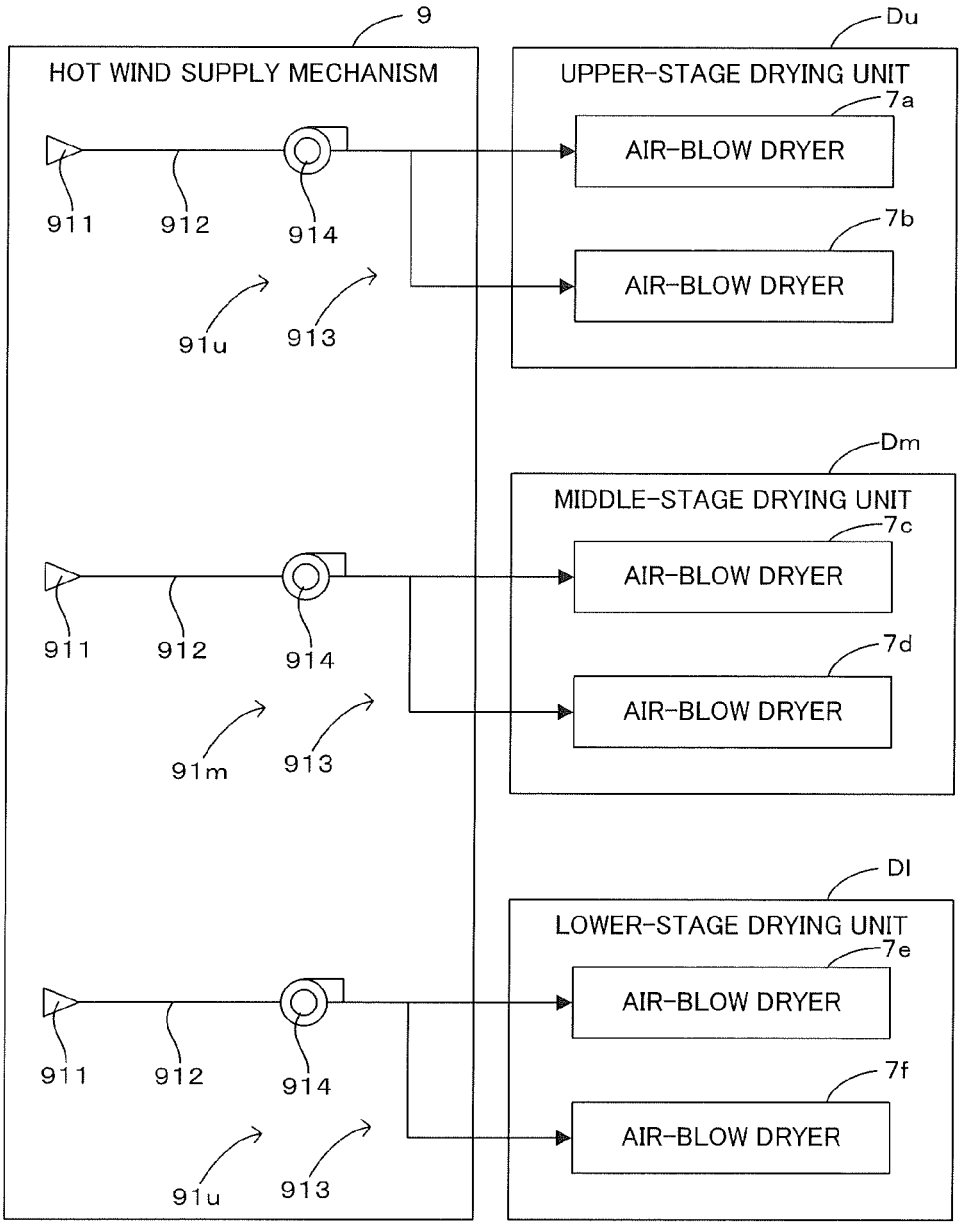
FIG. 6 is a block diagram schematically showing a hot wind supply mechanism equipped in the drying apparatus.

FIG. 6 is a block diagram schematically showing a hot wind supply mechanism equipped in the drying apparatus. An upper-stage drying unit Du including the air-blow dryers 7*a*, 7*b* arranged for the upper-stage conveying part 51*u*, a middle-stage drying unit Dm including the air-blow dryers 7*c*, 7*d* arranged for the middle-stage conveying part 51*m*, and a lower-stage drying unit D1 including the air-blow dryers 7*e*, 7*f* arranged for the lower-stage conveying part 51*l* are shown in FIG. 6.

The hot wind supply mechanism 9 includes an upper-stage supplying unit 91*u* supplying the hot wind to the upper-stage drying unit Du, a middle-stage supplying unit 91*m* supplying the hot wind to the middle-stage drying unit Dm and a lower-stage supplying unit 911 supplying the hot wind to the lower-stage drying unit D1. Since the upper-stage supplying unit 91*u*, the middle-stage supplying unit 91*m* and the lower-stage supplying unit 911 have a common configuration, this common configuration is described for the upper-stage supplying unit 91*u*.

The upper-stage supplying unit 91*u* includes an input part 911 to which the air heated by the external heater, i.e. the hot wind is input, an introduction pipe 912 which introduces the hot wind input from the input part 911, and a branched pipe 913 branched from the introduction pipe 912 to the respective air-blow dryers 7*a*, 7*b*. Accordingly, the hot wind input from the input part 911 is supplied to the respective air-blow dryers 7*a*, 7*b* via the branched pipe 913 after passing through the introduction pipe 912, and injected from the nozzles 76*u* of the respective air-blow dryers 7*a*, 7*b*. Further, a blower 914 which blows the hot wind from the side of the input part 911 to the side of the upper-stage drying unit Du is mounted in the introduction pipe 912, and a wind velocity (m/s) of the hot wind to be supplied to the respective air-blow dryers 7*a*, 7*b* is changed by changing a rotation speed of the blower 914, with the result that the wind velocity of the hot wind to be injected from the nozzles 76*u* can be adjusted.

Similarly, for the middle-stage drying unit Dm, the hot wind having the wind velocity thereof adjusted by a blower 914 is supplied to the air-blow dryers 7*c*, 7*d* by the middle-stage supplying unit 91*m*, and injected from the nozzles 76*u*, 76*l* of the air-blow dryers 7*c*, 7*d*. Further, for the lower-stage drying unit Dl, the hot wind having the wind velocity thereof adjusted by a blower 914 is supplied to the air-blow dryers 7*e*, 7*f* by the lower-stage supplying unit 911, and injected from the nozzles 76*u*, 76*l* of the air-blow dryers 7*e*, 7*f*.

Further, the rotation speeds of the blowers 914 of the upper-stage supplying unit 91*u*, the middle-stage supplying unit 91*m* and the lower-stage supplying unit 911 are adjusted in advance, for example, by an operator, and the wind velocity of the air injected from each nozzle 76*u* provided in the upper-stage drying unit Du is lower than that of the air injected from each nozzle 76*u*, 76*l* provided in the middle-stage drying unit Dm and lower than that of the air injected from each nozzle 76*u*, 76*l* provided in the lower-stage drying unit D1. Incidentally, the wind velocity may be adjusted regardless of the rotation speed of the blower 914. That is, a damper may be provided between the blower 914 and the branched pipe 913 and the wind velocity of the hot wind may be adjusted by changing an opening of the damper.

Further, in this example, the plurality of nozzles 76*u* of the air-blow dryers 7*a*, 7*b* inject the air at the same wind velocity. Accordingly, a uniform air can be injected to the front surface M1 of the printing medium M conveyed by the upper-stage conveying part 51*u* from the plurality of nozzles 76*u*.

Furthermore, the plurality of nozzles 76*l* of the air-blow dryers 7*c*, 7*d* inject the air at the same wind velocity. Accordingly, a uniform air can be injected to the front surface M1 of the printing medium M conveyed by the middle-stage conveying part 51*m* from the plurality of nozzles 76*l*.

Similarly, the plurality of nozzles 76*u* of the air-blow dryers 7*c*, 7*d* inject the air at the same wind velocity. Accordingly, a uniform air can be injected to the back surface M2 of the printing medium M conveyed by the middle-stage conveying part 51*m* from the plurality of nozzles 76*u*.

Particularly, in the air-blow dryers 7*c*, 7*d*, the wind velocity of the air injected by the plurality of nozzles 76*l* and that of the air injected by the plurality of nozzles 76*u* are equal. Accordingly, it can be suppressed that the printing medium M conveyed by the middle-stage conveying part 51*m* is shifted to contact either the nozzles 76*l* or the nozzles 76*u*.

Further, the wind velocity of the air injected by the nozzles 76*u* of the air-blow dryers 7*e*, 7*f* and that of the air injected by the nozzles 76*l* of the air-blow dryers 7*c*, 7*d* are equal. Accordingly, the drying of the printing medium M can be promoted by injecting the air at a high wind velocity to the front surface M1 of the printing medium M conveyed by the middle-stage conveying part 51*m* and the front surface M1 of the printing medium M conveyed by the lower-stage conveying part 51*l*.

Incidentally, in this specification, the hot wind is a wind of 60° C. or higher and the temperature of the hot wind is preferably 80° or higher. Further, the type of a gas injected from the nozzles 76*u*, 76*l* is not limited to the air as in this example.

In the embodiment described above, the printing medium M is dried by the hot wind in the air-blow dryers 7*c*, 7*d* (next-stage dryer) after the printing medium M is dried by the hot wind in the air-blow dryers 7*a*, 7*b* (preceding-stage dryer). Accordingly, in the air-blow dryers 7*a*, 7*b*, a temperature distribution of the printing medium M is nonuniform due to the latent heat of a large amount of moisture remaining on the printing medium M and the printing medium M is easily creased. As a countermeasure against this, in the air-blow dryers 7*a*, 7*b*, the back surface M2 (non-recording surface) of the printing medium M is supported by the rollers 74 (rotary bodies) while the hot wind is injected from the nozzles 76*u* (first nozzles) to the front surface M1 (recording surface) of the printing medium M. By extending the printing medium M along the rollers 74 in this way, the evaporation of the moisture on the printing medium M can be promoted by the hot wind while the formation of creases of the printing medium M is suppressed against the influence of the temperature distribution caused by the latent heat of the moisture on the printing medium M. After a certain amount of the moisture is evaporated in the air-blow dryers 7*a*, 7*b* in this way, the temperature of the printing medium M becomes relatively uniform. Thus, in the air-blow dryers 7*c*, 7*d*, the printing medium M is further dried by injecting the hot wind to the printing medium M from the nozzles 76*l* (second nozzles) and the nozzles 76*u* (third nozzles) arranged on both sides of the printing medium M. In this way, it is possible to suppress the contact of the printing medium M and the nozzles 76*u*, 76*l* due to the formation of creases of the printing medium M while realizing the efficient drying of the printing medium M by the injection of the hot wind from the nozzles 76*u*, 76*l*.

Further, in the air-blow dryers 7*a*, 7*b*, the nozzles 76*u* and the rollers 74 are arranged in a staggered manner in the moving direction (horizontal direction X) of the printing medium M conveyed by the conveying unit 51 (conveyor). In such a configuration, moisture evaporation from the front surface M1 of the printing medium M can be promoted by the hot wind from the nozzles 76*u*, and the formation of creases can be more reliably suppressed by firmly supporting the back surface M2 of the printing medium M by the rollers 74.

Further, in the air-blow dryers 7*c*, 7*d*, the nozzles 76*l* and the nozzles 76*u* are arranged in a staggered manner in the moving direction (horizontal direction X) of the printing medium M conveyed by the conveying unit 51. In such air-blow dryers 7*c*, 7*d*, the nozzles 76*l* and the nozzles 76*u* are displaced from each other in the moving direction of the printing medium M. Thus, it can be suppressed that the front surface M1 of the printing medium M deflected by the hot wind injected from the nozzles 76*u* contacts the nozzles 76*l*.

Further, there is a clearance between the nozzles 76*u* and the peripheral surfaces of the rollers 74 when viewed from the moving direction (horizontal direction X) of the printing medium M (in other words, the upper ends of the rollers 74 are located below the lower ends of the nozzles 76*u*) in the air-blow dryers 7*a*, 7*b*. If the injection of the hot wind from the nozzles 76*u* is stopped, the printing medium M is supported by the rollers 74 with the front surface M1 separated from the nozzles 76*u* and the back surface M2 held in contact with the rollers 74. In such a configuration, if the injection of the hot wind from the nozzle(s) 76*u* is stopped due to a trouble such as a power outage or the clogging of the nozzle(s) 76*u*, the printing medium M is supported by the rollers 74 with the front surface M1 of the printing medium M separated from the nozzles 76*u*. Therefore, the adhesion of the aqueous inks to the nozzles 76*u* and a disturbance of an image on the front surface M1 can be suppressed.

Further, in the vertical direction Z, the air-blow dryers 7*c*, 7*d* are arranged below the air-blow dryers 7*a*, 7*b*, in other words, the air-blow dryers 7*c*, 7*d* and the air-blow dryers 7*a*, 7*b* are arranged to overlap each other when viewed from the vertical direction Z. In such a configuration, the drying apparatus 5 can be reduced in size in the horizontal direction X.

Further, the moving direction of the printing medium M conveyed by the conveying unit 51 in the air-blow dryers 7*a*, 7*b* and that of the printing medium M conveyed by the conveying unit 51 in the air-blow dryers 7*c*, 7*d* are opposite. In view of this, the conveying unit 51 includes the rollers 52, 53 (preceding-stage inverter) which bend the printing medium M conveyed from the air-blow dryers 7*a*, 7*b* downward and further bend the printing medium M toward the air-blow dryers 7*c*, 7*d*. In such a configuration, the printing medium M can be precisely conveyed from the air-blow dryers 7*a*, 7*b* on an upper side to the air-blow dryers 7*c*, 7*d* on a lower side by the rollers 52, 53.

Further, the conveying unit 51 conveys the printing medium M in the air-blow dryers 7*a*, 7*b* with the front surface M1 facing up and the back surface M2 facing down and conveys the printing medium M in the air-blow dryers 7*c*, 7*d* with the front surface M1 facing down and the back surface M2 facing up. In the air-blow dryers 7*a*, 7*b*, the nozzles 76*u* are arranged above the printing medium M conveyed by the conveying unit 51 and the rollers 74 are arranged below the printing medium M conveyed by the conveying unit 51. In such a configuration, since the front surface M1 is facing up in the air-blow dryers 7*a*, 7*b* in which a large amount of moisture remains on the front surface M1, the moisture blown by the hot wind injected from the nozzles 76*u* can be prevented from falling down.

Further, the air-blow dryers 7*e*, 7*f* (succeeding-stage dryer) which dries the printing medium M by injecting the air toward the front surface M1 of the printing medium M being conveyed by the conveying unit 51 is equipped on a downstream side of the air-blow dryers 7*c*, 7*d* in the moving direction of the printing medium M conveyed by the conveying unit 51. These air-blow dryers 7*e*, 7*f* are arranged below the air-blow dryers 7*c*, 7*d*. The air-blow dryers 7*e*, 7*f* include the plurality of nozzles 76*u* (fifth nozzles) arrayed in the moving direction (horizontal direction X) of the printing medium M conveyed by the conveying unit 51 on the side of the front surface M1 of the printing medium M and the plurality of nozzles 76*l* (sixth nozzles) arrayed in the moving direction (horizontal direction X) of the printing medium M conveyed by the conveying unit 51 on the side of the back surface M2 of the printing medium M, the nozzles 76*u* inject the hot wind toward the front surface M1 of the printing medium M and the nozzles 76*l* inject the hot wind toward the back surface M2 of the printing medium M. In such a configuration, since the printing medium M dried by the air-blow dryers 7*c*, 7*d* is further dried by the air-blow dryers 7*e*, 7*f*, the printing medium M can be more reliably dried. Moreover, the air-blow dryers 7*e*, 7*f* are arranged below the air-blow dryers 7*c*, 7*d*, in other words, the air-blow dryers 7*c*, 7*d* and the air-blow dryers 7*e*, 7*f* are arranged to overlap each other when viewed from the vertical direction Z. Therefore, the drying apparatus 5 can be reduced in size in the horizontal direction X.

Further, the moving direction of the printing medium M conveyed by the conveying unit 51 in the air-blow dryers 7*c*, 7*d* and that of the printing medium M conveyed by the conveying unit 51 in the air-blow dryers 7*e*, 7*f* are opposite. In view of this, the conveying unit 51 includes the air turn bars 54, 55 (next-stage inverter) which bends the printing medium M conveyed from the air-blow dryers 7*c*, 7*d* downward and further bends the printing medium M toward the air-blow dryers 7*e*, 7*f*. In such a configuration, the printing medium M can be precisely conveyed from the air-blow dryers 7*c*, 7*d* on an upper side to the air-blow dryers 7*e*, 7*f* on a lower side by the air turn bars 54, 55.

Further, the printing system 1 is provided with the coating apparatus 2 (coating apparatus) which applies the primer to the front surface M1 of the printing medium M, and the printing apparatus 3 adheres the aqueous inks to the front surface M1 applied with the primer by the coating apparatus 2. In such a configuration, the aqueous inks can be fixed to the front surface M1 of the printing medium M by the primer.

In the embodiment described above, the printing system 1 corresponds to an example of a "printing system" of the invention, the coating apparatus 2 corresponds to an example of a "coating apparatus" of the invention, the printing apparatus 3 corresponds to an example of a "printing apparatus" of the invention, the drying apparatus 5 corresponds to an example of a "drying apparatus" of the invention, the conveying unit 51 corresponds to an example of a "conveyor" of the invention, the rollers 52, 53 correspond to an example of a "preceding-stage inverter" of the invention, the air turn bars 54, 55 correspond to an example of a "next-stager inverter" of the invention, the air-blow dryers 7*a*, 7*b* correspond to an example of a "preceding-stage dryer" of the invention, the air-blow dryers 7*c*, 7*d* correspond to an example of a "next-stage dryer" of the invention, the air-blow dryers 7*e*, 7*f* correspond to an example of a "succeeding-stage dryer" of the invention, the rollers 74 correspond to an example of "rotary bodies" of the invention, the nozzles 76*u* of the air-blow dryers 7*a*, 7*b* correspond to an example of "first nozzles" of the invention, the nozzles 76*l* of the air-blow dryers 7*c*, 7*d* correspond to an example of "second nozzles" of the invention, the nozzles 76*u* of the air-blow dryers 7*c*, 7*d* correspond to an example of "third nozzles" of the invention, the nozzles 76*u* of the air-blow dryers 7*e*, 7*f* correspond to an example of "fifth nozzles" of the invention, the nozzles 76*l* of the air-blow dryers 7*e*, 7*f* correspond to an example of "sixth nozzles" of the invention, the printing medium M corresponds to an example of a "printing medium" of the invention, the front surface M1 corresponds to an example of a "recording surface" of the invention, the back surface M2 corresponds to an example of a "non-recording surface" of the invention, a "conveying step" of the invention is performed by the conveying unit 51, a "preceding-stage drying step" of the invention is performed by the air-blow dryers 7*a*, 7*b* and a "next-stage drying step" of the invention is performed by the air-blow dryers 7*c*, 7*d*.

Note that the invention is not limited to the above embodiment and various changes other than the aforementioned ones can be made without departing from the gist of the invention. For example, in the air-blow dryer 7*a* or 7*b*, the number of the nozzles 76*u* and that of the rollers 74 need not be equal, and the number of the nozzles 76*u* may be more than or less than that of the rollers 74.

Figure 7:
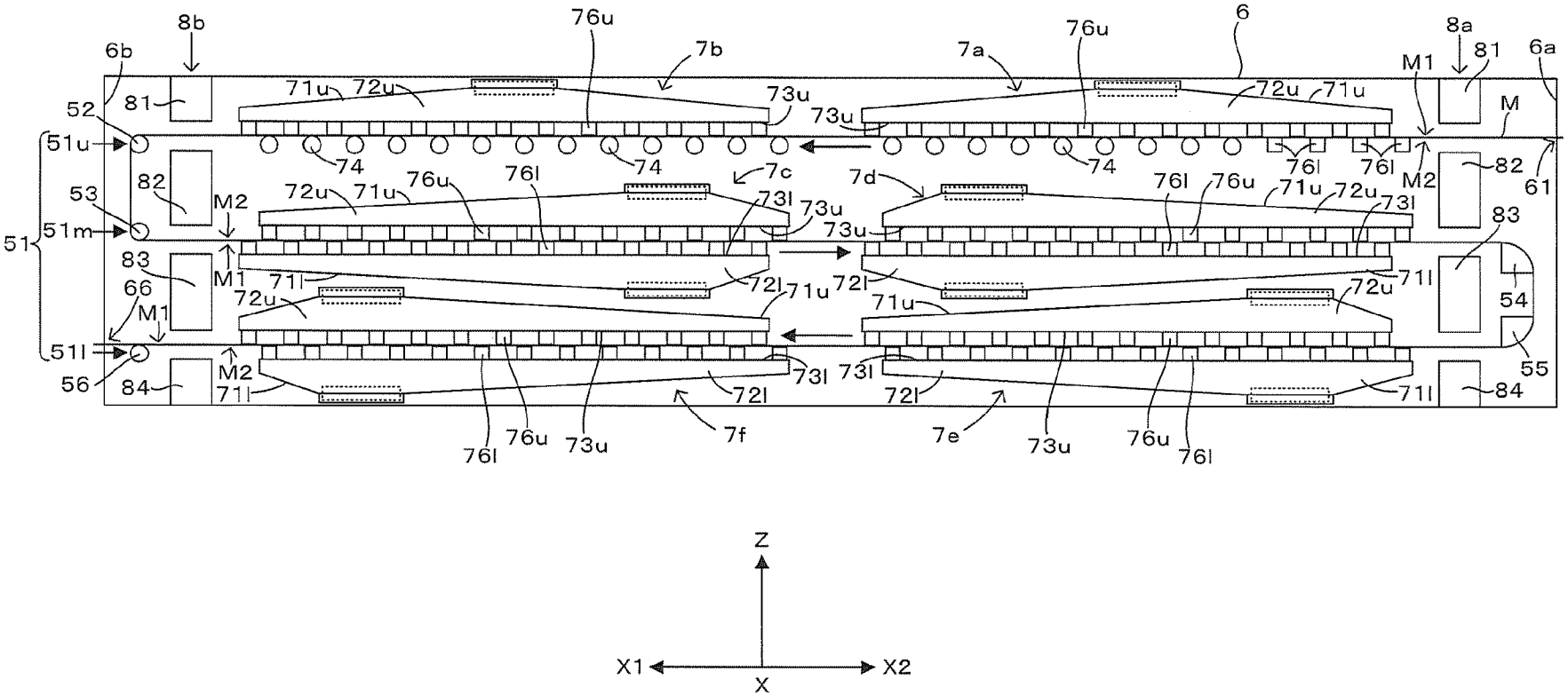
FIG. 7 is a front view schematically showing a modification of the drying apparatus.

Alternatively, as shown in FIG. 7, some rollers 74 may be replaced by nozzles 76*l*. Here, FIG. 7 is a front view schematically showing a modification of the drying apparatus. A drying apparatus 5 of FIG. 7 differs from the drying apparatus 5 of FIG. 3 in that an air-blow dryer 7*a* includes the nozzles 76*l* below the printing medium M, and the other configuration is common in these drying apparatuses 5.

The air-blow dryer 7*a* of the drying apparatus 5 shown in FIG. 7 includes a plurality of (less than the number of nozzles 76*u* by N) rollers 74 and N nozzles 76*l* arranged below the printing medium M. Note that N is an integer of 1 or greater, and "4" in this example. The plurality of rollers 74 are arrayed at a predetermined interval in the moving direction (horizontal direction X) of the printing medium M conveyed by the upper-stage conveying part 51*u*, and the peripheral surface of each roller 74 contacts the back surface M2 (lower surface) of the printing medium M, which is conveyed by the upper-stage conveying part 51*u*, from below. Further, the N nozzles 76*l* are arrayed at a predetermined interval in the horizontal direction X and inject a hot wind to the back surface M2 of the printing medium M from below. In the moving direction of the printing medium M conveyed by the upper-stage conveying part 51*u*, the plurality of these rollers 74 are located downstream of the N nozzles 76*l*, and the printing medium M conveyed by the upper-stage conveying part 51*u* is supported from below by the rollers 74 after the hot wind is injected from the nozzles 76*l*.

As just described, in the example of FIG. 7, the air-blow dryers 7*a*, 7*b* (preceding-stage dryer) include the nozzles 76*l* (fourth nozzle) arranged upstream of the most upstream roller 74, out of the plurality of rollers 74 (rotary bodies), in the moving direction of the printing medium M conveyed by the upper-stage conveying part 51*u* on the side of the back surface M2 (non-recording surface) of the printing medium M, and the nozzles 76*l* inject the hot wind to the back surface M2. That is, in an initial stage in which the printing medium M enters the air-blow dryers 7*a*, 7*b* through the carry-in port 61, a temperature distribution in the printing medium M is relatively uniform. Thus, the drying of the printing medium M can be promoted by injecting the hot wind to the back surface M2 of the printing medium M from the nozzles 76*l*.

Figure 8:
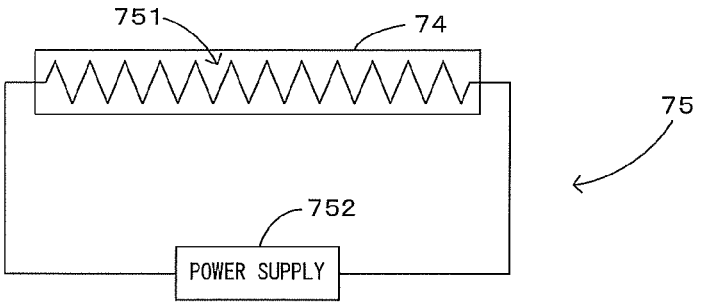
FIG. 8 is a diagram schematically showing another modification of the drying apparatus.

FIG. 8 is a diagram schematically showing another modification of the drying apparatus. In this modification, a drying apparatus 5 includes heating unit 75 which heats a plurality of rollers 74. The heating unit 75 includes a heating wire 751 arranged inside the roller 74 and a power supply 752 supplying a current to the heating wire 751. The heating wire 751 is provided in each of the plurality of rollers 74. The heating wire 751 generates heat by the current supplied from the power supply 752 and heats the roller 74. Accordingly, the printing medium M conveyed by the upper-stage conveying part 51*u* is supported from below by the heated rollers 74. In such a configuration, the drying of the printing medium M can be promoted by the heat of the rollers 74.

Further, modifications different from those of FIGS. 7 and 8 can also be added. For example, the air-blow dryer 7*b* may have the same configuration as the air-blow dryer 7*e*. In such a modification, the air-blow dryer 7*b* does not include the rollers 74 and supports the printing medium M by nozzles 76*u* and nozzles 76*l* arranged above and below the printing medium M, and only the air-blow dryer 7*a* includes the rollers 74. Thus, the air-blow dryer 7*a* corresponds to an example of the "preceding-stage dryer" of the invention, and the air-blow dryers (air-blow dryer 7*b*, etc.) downstream of the air-blow dryer 7*a* in the moving direction of the printing medium M conveyed by the conveying unit 51 correspond to an example of the "succeeding-stage dryer" of the invention.

Further, it is not always necessary to arrange two air-blow dryers for each of the upper-stage conveying part 51*u*, the middle-stage conveying part 51*m* and the lower-stage conveying part 51*l*. Accordingly, a single air-blow dryer 7*a* may be arranged for the upper-stage conveying part 51*u*, a single air-blow dryer 7*d* may be arranged for the middle-stage conveying part 51*m* and a single air-blow dryer 7*e* may be arranged for the lower-stage conveying part 51*l*.

Further, the air-blow dryers 7*a* to 7*f* need not necessarily be arranged separately in the vertical direction. Accordingly, the air-blow dryers 7*a* to 7*d* may be arranged at the same height and arrayed in the horizontal direction X. Alternatively, the air-blow dryers 7*a* to 7*f* may be arranged at the same height and arrayed in the horizontal direction X.

Further, the upper-stage supplier 91*u*, the middle-stage supplier 91*m* and the lower-stage supplier 911 need not have the same configuration. Accordingly, a feedback pipe to return the air exhausted from the exhaust chambers 82, 83 to the introduction pipe 912 of the middle-stage supplier 91*m* may be, for example, provided. Further, a similar feedback pipe may be provided in the lower-stage supplier 911 to return the air exhausted from the exhaust chambers 83, 84.

Further, the specific configuration of the conveying unit 4 of the printing apparatus 3 is not limited to the above example. Accordingly, the arrangement or number of the rollers can be changed as appropriate in the carry-in part 41, the ascending conveying part 42, the upper conveying part 43, the descending conveying part 44, the color conveying part 45, the inverting conveying part 47, the white conveying part 48 and the carry-out part 49.

Further, the printing medium M needs not be carried into the housing 31 of the printing apparatus 3 through the carry-in part 41. For example, the printing apparatus 3 may be so configured as to carry the printing medium M into the upper conveying part 43 from the one side X1 of the housing 31 without providing the carry-in part 41 and the ascending conveying part 42.

Further, it is not essential to provide the pre-dryer 34 and the upper dryer 35 in the printing apparatus 3.

As described above, the drying apparatus may be configured so that the first nozzles and the rotary bodies are arranged in a staggered manner in the moving direction of the printing medium conveyed by the conveyor in the preceding-stage dryer. In such a configuration, moisture evaporation from the recording surface of the printing medium can be promoted by the hot wind from the first nozzles, and the formation of creases can be more reliably suppressed by firmly supporting the non-recording surface of the printing medium by the rotary bodies.

The drying apparatus may be configured so that the second nozzles and the third nozzles are arranged in a staggered manner in the moving direction of the printing medium conveyed by the conveyor in the next-stage dryer. In such a next-stage dryer, the second nozzles and the third nozzles are displaced from each other in the moving direction of the printing medium. Thus, it can be suppressed that the recording surface of the printing medium deflected by the hot wind injected from the third nozzles contacts the second nozzles.

The drying apparatus may be configured so that the preceding-stage dryer includes a fourth nozzle arranged upstream of the most upstream rotary body, out of the plurality of rotary bodies, in the moving direction of the printing medium conveyed by the conveyor on the non-recording surface side of the printing medium, and the fourth nozzle injects the hot wind to the non-recording surface. That is, since the temperature distribution in the printing medium is relatively uniform in an initial state in which the printing medium enters the preceding-stage dryer, the drying of the printing medium can be promoted by injecting the hot wind to the non-recording surface of the printing medium from the fourth nozzle.

The drying apparatus may be configured so that there is a clearance between the first nozzles and the peripheral surfaces of the rotary bodies when viewed from the moving direction of the printing medium conveyed by the conveyor in the preceding-stage dryer, and the printing medium is supported with the recording surface separated from the first nozzles and the non-recording surface held in contact with the rotary bodies if the injection of the hot wind from the first nozzles is stopped.

In such a configuration, if the injection of the hot wind from the first nozzle(s) is stopped due to a trouble such as a power outage or the clogging of the nozzle(s), the printing medium is supported by the rotary bodies with the recording surface of the printing medium separated from the first nozzles. Therefore, the adhesion of the aqueous ink to the first nozzles and a disturbance of an image on the recording surface can be suppressed.

The drying apparatus according to claim 1, wherein the next-stage dryer is arranged below the preceding-stage dryer in a vertical direction. In such a configuration, the drying apparatus can be reduced in size in the horizontal direction.

The drying apparatus may be configured so that a moving direction of the printing medium conveyed by the conveyor in the preceding-stage dryer and a moving direction of the printing medium conveyed by the conveyor in the next-stage dryer are opposite, and the conveyor includes a preceding-stage inverter which bends the printing medium conveyed from the preceding-stage dryer downward and further bends the printing medium toward the next-stage dryer. In such a configuration, the printing medium can be precisely conveyed from the preceding-stage dryer on an upper side to the next-stage dryer on a lower side by the preceding-stage inverter.

The drying apparatus may be configured so that the conveyor conveys the printing medium in the preceding-stage dryer with the recording surface facing up and the non-recording surface facing down and conveys the printing medium in the next-stage dryer with the recording surface facing down and the non-recording surface facing up, the first nozzles are arranged above the printing medium conveyed by the conveyor, the rotary bodies are arranged below the printing medium conveyed by the conveyor, the second nozzles are arranged below the printing medium conveyed by the conveyor, and the third nozzles are arranged above the printing medium conveyed by the conveyor. In such a configuration, since the recording surface is facing up in the preceding-stage dryer in which a large amount of moisture remains on the recording surface, the moisture blown by the hot wind injected from the first nozzles can be prevented from falling down.

The drying apparatus may further comprises a succeeding-stage dryer which dries the printing medium by injecting a gas toward the recording surface of the printing medium being conveyed by the conveyor on a side downstream of the next-stage dryer in the moving direction of the printing medium conveyed by the conveyor, wherein: the succeeding-stage dryer is arranged below the next-stage dryer in a vertical direction, the succeeding-stage dryer includes a plurality of fifth nozzles arrayed in the moving direction of the printing medium conveyed by the conveyor on the recording surface side of the printing medium and a plurality of sixth nozzles arrayed in the moving direction of the printing medium conveyed by the conveyor on the non-recording surface side of the printing medium, the fifth nozzles inject the hot wind to the recording surface, and the sixth nozzles inject the hot wind to the non-recording surface. In such a configuration, since the printing medium dried by the next-stage dryer is further dried by the succeeding-stage dryer, the printing medium can be more reliably dried. Moreover, since the succeeding-stage dryer is arranged below the next-stage dryer, the drying apparatus can be reduced in size in the horizontal direction.

The drying apparatus may be configured so that a moving direction of the printing medium conveyed by the conveyor in the next-stage dryer and a moving direction of the printing medium conveyed by the conveyor in the succeeding-stage dryer are opposite, and the conveyor includes a next-stage inverter which bends the printing medium conveyed from the next-stage dryer downward and further bends the printing medium toward the succeeding-stage dryer. In such a configuration, the printing medium can be precisely conveyed from the next-stage dryer on an upper side to the succeeding-stage dryer on a lower side by the next-stage inverter.

Note that the arrangement of the preceding-stage dryer and the next-stage dryer is not limited to the above example. The drying apparatus may be configured so that the preceding-stage dryer and the next-stage dryer are arrayed in a horizontal direction.

The drying apparatus may further comprise a heating unit to heat the rotary bodies.

In such a configuration, the drying of the printing medium can be promoted by the heat of the rotary bodies.

The printing system may further comprise a coating apparatus which applies a primer to the recording surface of the printing medium, wherein: the printing apparatus adheres the aqueous ink to the recording surface having the primer applied thereto by the coating apparatus. In such a configuration, the aqueous ink can be fixed to the recording surface of the printing medium by the primer.

The invention is applicable to techniques in general for drying a printing medium M adhered with aqueous ink(s) by a hot wind.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A drying apparatus, comprising:

a conveyor which conveys a printing medium having a recording surface and a non-recording surface opposite to the recording surface, an aqueous ink adhering to the recording surface;

a preceding-stage dryer which dries the printing medium being conveyed by the conveyor;

a next-stage dryer which dries the printing medium being conveyed by the conveyor on a side downstream of the preceding-stage dryer in a moving direction of the printing medium conveyed by the conveyor; and a housing accommodating the conveyor, the preceding-state dryer, and the next-stage dryer, wherein:

the preceding-stage dryer includes a plurality of first nozzles arrayed in the moving direction of the printing medium conveyed by the conveyor on a recording surface side of the printing medium and a plurality of rotary bodies arrayed in the moving direction of the printing medium conveyed by the conveyor on a non-recording surface side of the printing medium, the first nozzles inject a hot wind of 60° C. or higher to the recording surface, the rotary bodies have peripheral surfaces configured to contact the non-recording surface of the printing medium and rotate, following the printing medium, the next-stage dryer includes a plurality of second nozzles arrayed in the moving direction of the printing medium conveyed by the conveyor on the recording surface side of the printing medium and a plurality of third nozzles arrayed in the moving direction of the printing medium conveyed by the conveyor on the non-recording surface side of the printing medium, the second nozzles inject the hot wind to the recording surface, the third nozzles inject the hot wind to the non-recording surface, and the housing further accommodates an exhaust unit that exhausts air in the housing to outside of the housing.

2. The drying apparatus according to claim 1, wherein the first nozzles and the rotary bodies are arranged in a staggered manner in the moving direction of the printing medium conveyed by the conveyor in the preceding-stage dryer.

3. The drying apparatus according to claim 1, wherein the second nozzles and the third nozzles are arranged in a staggered manner in the moving direction of the printing medium conveyed by the conveyor in the next-stage dryer.

4. The drying apparatus according to claim 1, wherein:

the preceding-stage dryer includes a fourth nozzle arranged upstream of the most upstream rotary body, out of the plurality of rotary bodies, in the moving direction of the printing medium conveyed by the conveyor on the non-recording surface side of the printing medium, and the fourth nozzle injects the hot wind to the non-recording surface.

5. The drying apparatus according to claim 1, wherein there is a clearance between the first nozzles and the peripheral surfaces of the rotary bodies when viewed from the moving direction of the printing medium conveyed by the conveyor in the preceding-stage dryer, and the printing medium is supported with the recording surface separated from the first nozzles and the non-recording surface held in contact with the rotary bodies if the injection of the hot wind from the first nozzles is stopped.

6. The drying apparatus according to claim 1, wherein the next-stage dryer is arranged below the preceding-stage dryer in a vertical direction.

7. The drying apparatus according to claim 6, wherein:

a moving direction of the printing medium conveyed by the conveyor in the preceding-stage dryer and a moving direction of the printing medium conveyed by the conveyor in the next-stage dryer are opposite, and the conveyor includes a preceding-stage inverter which bends the printing medium conveyed from the preceding-stage dryer downward and further bends the printing medium toward the next-stage dryer.

8. The drying apparatus according to claim 7, wherein:

the conveyor conveys the printing medium in the preceding-stage dryer with the recording surface facing up and the non-recording surface facing down and conveys the printing medium in the next-stage dryer with the recording surface facing down and the non-recording surface facing up, the first nozzles are arranged above the printing medium conveyed by the conveyor, the rotary bodies are arranged below the printing medium conveyed by the conveyor, the second nozzles are arranged below the printing medium conveyed by the conveyor, and the third nozzles are arranged above the printing medium conveyed by the conveyor.

9. The drying apparatus according to claim 7, further comprising a succeeding-stage dryer which dries the printing medium by injecting a gas toward the recording surface of the printing medium being conveyed by the conveyor on a side downstream of the next-stage dryer in the moving direction of the printing medium conveyed by the conveyor, wherein:

the succeeding-stage dryer is arranged below the next-stage dryer in a vertical direction, the succeeding-stage dryer includes a plurality of fifth nozzles arrayed in the moving direction of the printing medium conveyed by the conveyor on the recording surface side of the printing medium and a plurality of sixth nozzles arrayed in the moving direction of the printing medium conveyed by the conveyor on the non-recording surface side of the printing medium, the fifth nozzles inject the hot wind to the recording surface, and the sixth nozzles inject the hot wind to the non-recording surface.

10. The drying apparatus according to claim 9, wherein:

a moving direction of the printing medium conveyed by the conveyor in the next-stage dryer and a moving direction of the printing medium conveyed by the conveyor in the succeeding-stage dryer are opposite, and the conveyor includes a next-stage inverter which bends the printing medium conveyed from the next-stage dryer downward and further bends the printing medium toward the succeeding-stage dryer.

11. The drying apparatus according to claim 1, wherein the preceding-stage dryer and the next-stage dryer are arrayed in a horizontal direction.

12. The drying apparatus according to claim 1, further comprising a heating unit to heat the rotary bodies.

13. A printing system, comprising:

a printing apparatus which adheres an aqueous ink to a recording surface of a printing medium having the recording surface and a non-recording surface opposite to the recording surface; and the drying apparatus according to claim 1, the printing medium having the aqueous ink adhered thereto by the printing apparatus being dried by the drying apparatus.

14. The printing system according to claim 13, further comprising a coating apparatus which applies a primer to the recording surface of the printing medium, wherein:

the printing apparatus adheres the aqueous ink to the recording surface having the primer applied thereto by the coating apparatus.

15. A drying method, comprising:

a conveying step of conveying a printing medium having a recording surface to which an aqueous ink adhered and a non-recording surface opposite to the recording surface by a conveyor;

a preceding-stage drying step of drying the printing medium being conveyed by the conveyor by a preceding-stage dryer;

a next-stage drying step of drying the printing medium being conveyed by the conveyor by a next-stage dryer on a side downstream of the preceding-stage dryer in a moving direction of the printing medium conveyed by the conveyor; and an exhausting step of exhausting air in a housing, by an exhaust unit, to outside of the housing, the housing accommodating the conveyor, the preceding-state dryer, the next-stage dryer, and the exhaust unit, wherein:

the preceding-stage dryer includes a plurality of first nozzles arrayed in the moving direction of the printing medium conveyed by the conveyor on a recording surface side of the printing medium and a plurality of rotary bodies arrayed in the moving direction of the printing medium conveyed by the conveyor on a non-recording surface side of the printing medium, the first nozzles inject a hot wind of 60° C. or higher to the recording surface, the rotary bodies have peripheral surfaces configured to contact the non-recording surface of the printing medium and rotate, following the printing medium, the next-stage dryer includes a plurality of second nozzles arrayed in the moving direction of the printing medium conveyed by the conveyor on the recording surface side of the printing medium and a plurality of third nozzles arrayed in the moving direction of the printing medium conveyed by the conveyor on the non-recording surface side of the printing medium, the second nozzles inject the hot wind to the recording surface, and the third nozzles inject the hot wind to the non-recording surface.

* * * * *